US012264444B1

(12) United States Patent
Yu et al.

(10) Patent No.: US 12,264,444 B1
(45) Date of Patent: Apr. 1, 2025

(54) PREFABRICATED MOVABLE AND ADJUSTABLE SUPPORT FRAME FOR CONSTRUCTION CROSSING OVER EXISTING LINE, AND METHOD OF INSTALLING SAME

(71) Applicant: Central South University, Changsha (CN)

(72) Inventors: Yujie Yu, Changsha (CN); Xiaoxiang Wang, Changsha (CN); Ben Mou, Changsha (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 18/677,556

(22) Filed: May 29, 2024

(30) Foreign Application Priority Data

Jan. 30, 2024 (CN) ..... 202410126906.1

(51) Int. Cl.
*E01F 1/00* (2006.01)
*B61D 15/00* (2006.01)

(52) U.S. Cl.
CPC ..... *E01F 1/005* (2013.01); *B61D 15/00* (2013.01)

(58) Field of Classification Search
CPC ..... E01F 1/005; E01D 21/00; B61D 15/00; B61D 15/04; B61D 15/08
See application file for complete search history.

(56) References Cited

FOREIGN PATENT DOCUMENTS

| | | | | | |
|---|---|---|---|---|---|
| CN | 205954489 | U | | 2/2017 | |
| CN | 111119922 | A | * | 5/2020 | ..... B62D 57/02 |
| CN | 112196245 | A | | 1/2021 | |
| CN | 113665606 | A | * | 11/2021 | ..... B61D 15/08 |
| CN | 216305320 | U | | 4/2022 | |
| CN | 114751343 | A | * | 7/2022 | ..... B66F 11/04 |
| CN | 218988728 | U | * | 5/2023 | ..... B66F 11/04 |
| CN | 219081109 | U | | 5/2023 | |
| CN | 219219718 | U | | 6/2023 | |
| CN | 220247529 | U | | 12/2023 | |
| KR | 20230174383 | A | * | 12/2023 | ..... B61D 15/00 |
| WO | WO-2019119021 | A1 | * | 6/2019 | ..... B61D 15/08 |

* cited by examiner

*Primary Examiner* — Robert J McCarry, Jr.
(74) *Attorney, Agent, or Firm* — George D. Morgan

(57) ABSTRACT

Provided is a prefabricated movable and adjustable support frame for construction crossing over an existing line, and a method of installing the same used in field of railway construction engineering, the support frame including a rail track of the existing line, an adjustable support, a slideway stringer, a support beam, a hinge, a brake device, and a traction mechanism, where the adjustable support includes 4 pillar assemblies, each of the pillar assemblies includes an outer column and an inner column, the inner column is inserted into the outer column, a lower end of the outer column is connected to a lower rail wheel, an upper end of the inner column is connected to an upper pulley, the inner columns adjacent to each other and the outer columns adjacent to each other along the rail track of the existing line are connected by hinged nodes through a cross brace assembly.

9 Claims, 6 Drawing Sheets

PREFABRICATED MOVABLE AND ADJUSTABLE SUPPORT FRAME FOR CONSTRUCTION CROSSING OVER EXISTING LINE, AND METHOD OF INSTALLING SAME

CROSS-REFERENCE TO RELATED APPLICATIONS

The application claims priority to Chinese patent application No. 2024101269061, filed on Jan. 30, 2024, the entire contents of which are incorporated herein by reference.

TECHNICAL FIELD

The present invention relates to the field of railway construction engineering, and in particular, to a prefabricated movable and adjustable support frame for construction crossing over an existing line, and a method of installing the same.

BACKGROUND

A support frame for construction crossing over an existing line is a temporary support structure used for construction work crossing over an existing railway line in railway construction. It is commonly used in situations such as building of new bridges or tunnels, line extensions or modifications, repair and overhaul work, and temporary access during construction. Common types of support frames for construction crossing over an existing line include steel support frames, concrete support frames, and combined support frames. The steel support frames are usually composed of steel members and supporting scaffolding, with a high load-bearing capacity. The concrete support frames are built using concrete beams, columns, piers, and other members, with high strength and durability. The combined support frames combine the steel support frames and the concrete support frames, with the advantages of both types of support frames.

The erection of support frames for construction crossing over an existing line in the prior art is capable of effectively protecting the safety and integrity of the existing line, reducing impact and vibration on the existing line, avoiding damage to the existing line, and ensuring the normal operation of the existing line during construction. However, there are still some shortcomings in construction assembly/disassembly and construction accuracy adjustment, including difficulty in assembly/disassembly, inconvenience in construction accuracy adjustment, and a large impact on the existing line. Therefore, further research and improvement of construction technology, thereby improving construction efficiency and accuracy, and reducing impact on line operation, are the directions that need to be focused on. Through reasonable design and use of support frames, the safety, efficiency, and smooth progress of railway projects can be ensured.

SUMMARY

In view of the shortcomings described above, the technical problem to be solved by the present invention is to provide a prefabricated movable and adjustable support frame for construction crossing over an existing line that is effectively improved in construction assembly/disassembly and construction precision adjustment, and a method of installing the same. The present invention can achieve fully prefabricated assembly/disassembly of members of the support frame for construction, and through a combination of a lower rail wheel and an upper pulley, the entire support frame can be slid and transferred using a rail track of the existing line; in addition, the height of the support frame can be flexibly adjusted and controlled through a hinge and a traction mechanism.

A technical solution adopted by the present invention to solve the technical problem is as follows: a prefabricated movable and adjustable support frame for construction crossing over an existing line, including a rail track of the existing line, an adjustable support, a slideway stringer, a support beam, a hinge, a brake device, and a traction mechanism, where the adjustable support includes 4 pillar assemblies, each of the pillar assemblies includes an outer column and an inner column, the inner column is inserted into the outer column and can slide vertically inside the outer column, a lower end of the outer column is connected to a lower rail wheel that can roll on the rail track of the existing line, an upper end of the inner column is connected to an upper pulley, the inner columns adjacent to each other and the outer columns adjacent to each other along the rail track of the existing line are connected by hinged nodes through a cross brace assembly, with a distance there between adjustable, and the inner columns adjacent to each other and the outer columns adjacent to each other along a direction perpendicular to the rail track of the existing line are connected by a fixed crossbar, with an axis distance there between equal to the track gauge of the existing line; the slideway stringer is arranged on the adjustable support, a chute type slideway is provided at a lower end of the slideway stringer, and the inner column and the upper pulley disposed at the upper end thereof can be inserted into and roll along the chute type slideway; the support beam is arranged across the slideway stringer and serves as a supporting end of the support frame for construction; the hinge is installed between the outer columns of the adjustable support adjacent to each other along the rail track of the existing line and connected to the traction mechanism; and the brake device is installed on a side of the outer column of the adjustable support.

Further, the outer diameter of the inner column is 1-2 cm smaller than the inner diameter of the outer column.

Further, one side of the cross brace assembly has an upper end hinged to the inner column and a lower end hinged to the outer column, while the other side thereof has an upper end hinged to the inner column adjacent thereto and a lower end hinged to the outer column adjacent thereto.

Further, both ends of the fixed crossbar are respectively connected to the outer column.

Further, the inner diameter of the chute type slideway is 1-2 cm larger than the outer diameter of the inner column.

Further, limiting baffles are welded at a certain spacing inside the chute type slideway.

Further, the hinge may be a ring buckle hinge or a ratchet buckle hinge.

Further, the traction mechanism includes a traction motor connected to two output shafts through a gearbox provided with forward and reverse gears, each of the output shafts is provided with a gear, a separating baffle is provided in the middle of the gears, the gears are assembled and connected to both ends of the hinge, and the traction motor drives the gears to rotate toward or away from each other to achieve tensioning or relaxing of the hinge.

Further, the brake device includes a handle, a slidable connecting rod, a slidable snap ring, and a brake end, where an end of the slidable snap ring is provided with a sliding groove, the slidable connecting rod passes through the sliding groove, having an upper end hinged to the handle and a lower end connected to the brake end, the handle is hinged to the outer column through a handle joint, when the handle is leveled, the brake end can abut against the rail track of the existing line, and when the handle is turned upward, the slidable connecting rod drives the brake end to break away from the rail track of the existing line.

The present invention further proposes a method of installing the prefabricated movable and adjustable support frame for construction crossing over an existing line, including the following steps:

(1) placing two of the outer columns at a spacing equal to the track gauge of the existing line, and fixing them by welding or bolting with the fixed crossbar, arranging 2 sets respectively, and installing the brake device on the outside of each of the outer columns;

(2) inserting the inner column into the outer column to form a pillar assembly, and then connecting the cross brace assembly along the rail track of the existing line to form an adjustable support;

(3) lifting the assembled adjustable support onto the rail track of the existing line, and placing the hinge between the outer columns adjacent to each other along the rail track of the existing line, with both ends thereof inserted into the traction mechanism;

(4) lifting the slideway stringer onto the adjustable support, with an upper pulley of the inner column in the adjustable support inserted into the chute type slideway of the slideway stringer, and placing one of the adjustable supports in a partition on one side of the limiting baffle in the slideway stringer;

(5) placing the support beam across the slideway stringer as the supporting end of the support frame for construction;

(6) during construction crossing over the existing line, pulling up the handle of the brake device to drive the brake end to break away from the rail track of the existing line, rolling the entire construction support frame on the rail track of the existing line to a designated position, and then leveling the handle of the brake device;

(7) starting the traction mechanism to control the hinge to be contracted, thereby tensioning the hinge to reduce the length thereof so that the angle of the cross brace assembly changes to push the inner column to rise, thus lifting the slideway stringer and the support beam to a designated height, and then stopping the traction mechanism; and (8) when the construction of a current section is completed and it needs to move to a next section, starting the traction mechanism to control the hinge to be released, thereby relaxing the hinge to increase both the spacing between the inner columns adjacent to each other and the spacing between the outer columns adjacent to each other so that the angle of the cross brace assembly changes to cause the inner columns, the slideway stringer, and the support beam to fall naturally; and pulling up the handle of the brake device to transfer the entire construction support frame along the rail track of the existing line to the next section.

Compared with the prior art, the present invention has the following beneficial effects:

the connecting assemblies in the support frame are connected by insertion or hinging, thereby allowing for fully prefabricated assembly/disassembly. After the construction is completed, the assemblies can be quickly disassembled, and since individual members are small in size, they are convenient for storage and transportation after disassembly. The support frame can be combined through a series of standardized inner columns, outer columns, and cross brace assemblies to form support frames meeting different length requirements, and through a combination of the lower rail wheel and the upper pulley at the end of the adjustable support, the entire support frame can be slid and transferred using the rail track of the existing line, thereby facilitating position adjustment and transfer of the support frame between different construction sites; in addition, the height of the support frame can be flexibly adjusted and controlled through the hinge and the traction mechanism in accordance with the construction requirements.

REFERENCE SIGNS

1: rail track of an existing line; 2: adjustable support; 3: slideway stringer; 4: support beam; 5: hinge; 6: brake device; 7: traction mechanism;

21: outer column; 22: lower rail wheel; 23: inner column; 24: upper pulley; 25: cross brace assembly; 26: fixed crossbar;

31: chute type slideway; 32: lifting baffle;

61: handle; 62: slidable connecting rod; 63: slidable snap ring; 64: brake end; 65: handle joint;

71: gear; and 72: separating baffle.

DETAILED DESCRIPTION OF THE EMBODIMENTS

The present invention is further described below in conjunction with the accompanying drawings and embodiments.

Figure 1:
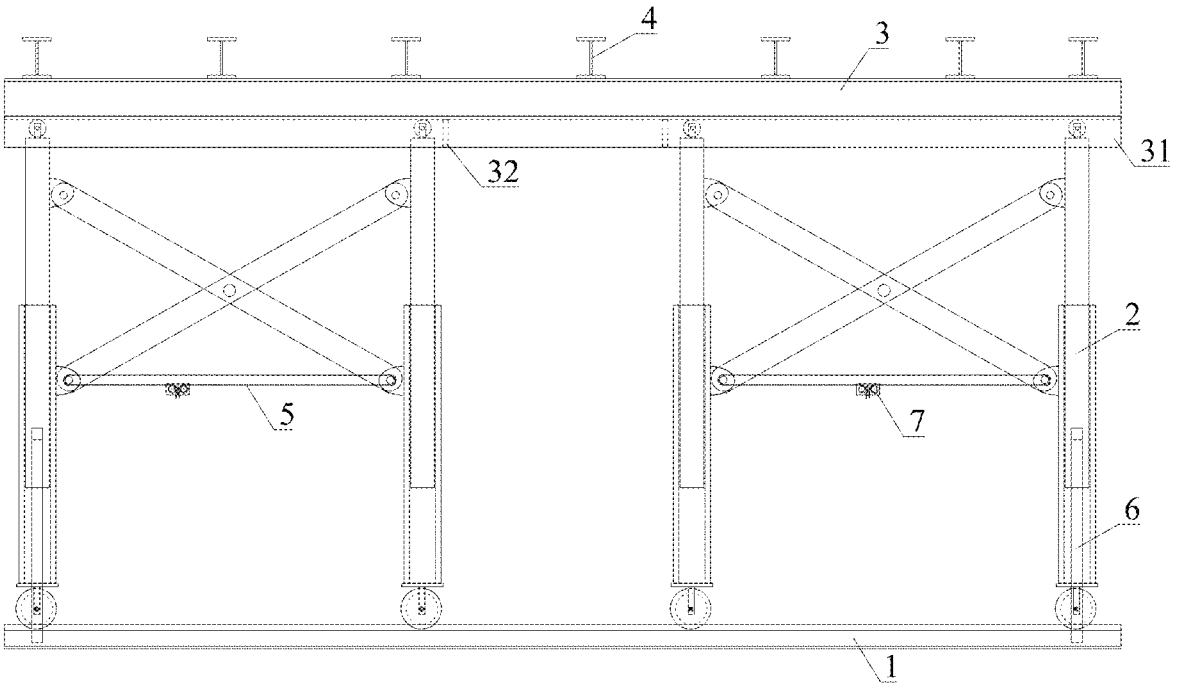
FIG. 1 is a schematic diagram of the support frame for construction in an unlifted state after assembly.
Figure 2:
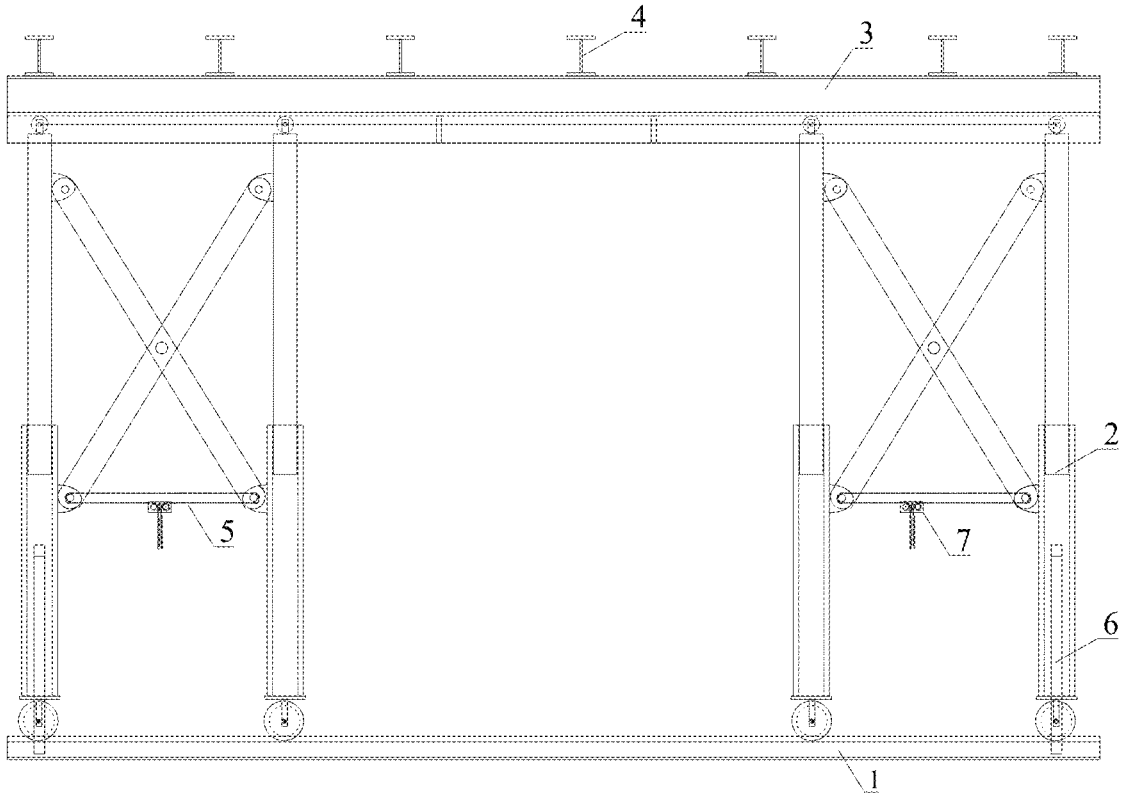
FIG. 2 is a schematic diagram of the support frame for construction in a lifted state when the traction mechanism is used to tension the hinge.
Figure 3:
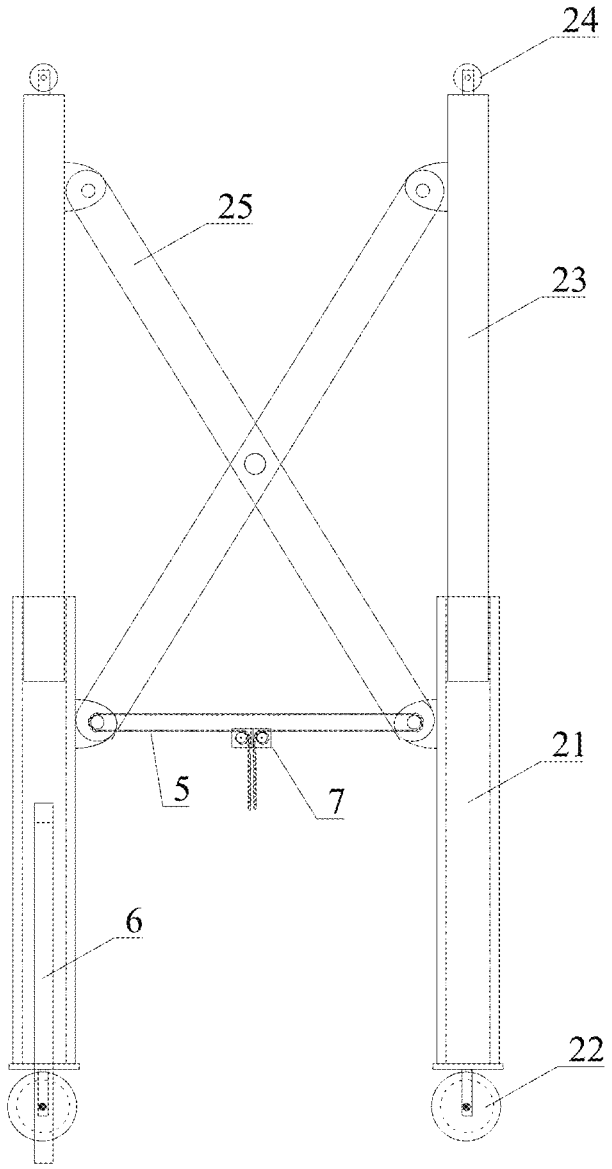
FIG. 3 is a schematic diagram of a state after the adjustable support and the hinge are assembled.
Figure 4:
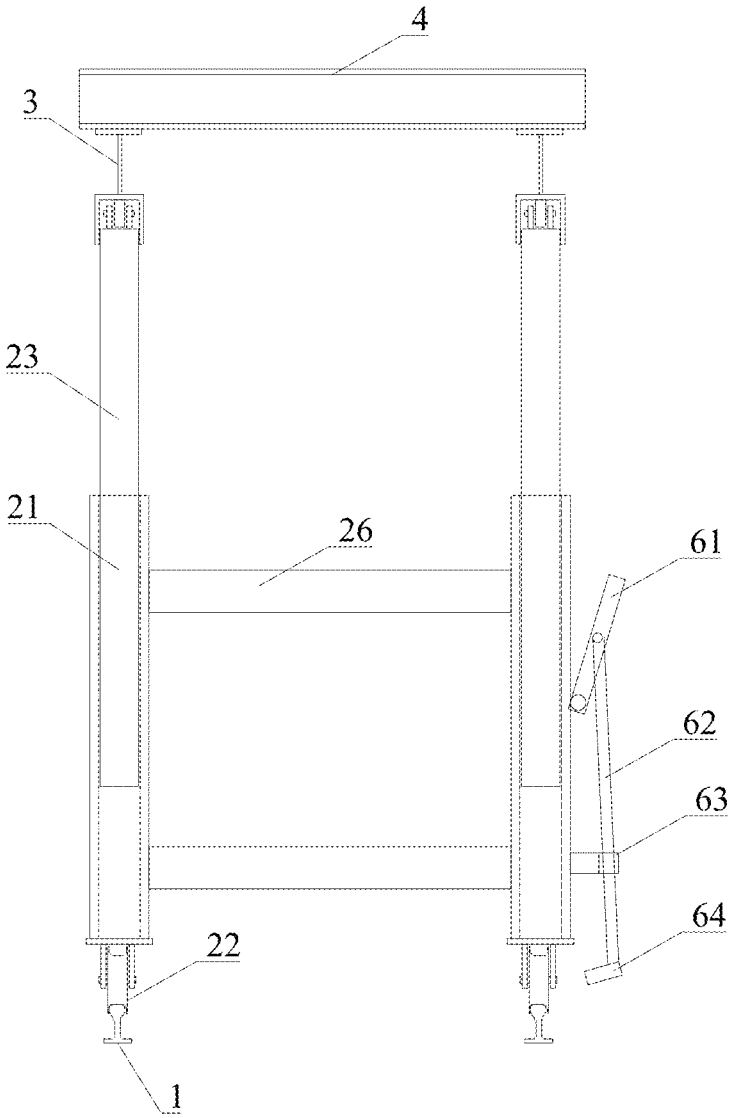
FIG. 4 is a schematic diagram of the support frame for construction along the rail track of the existing line when the handle of the brake device is pulled up.
Figure 5:
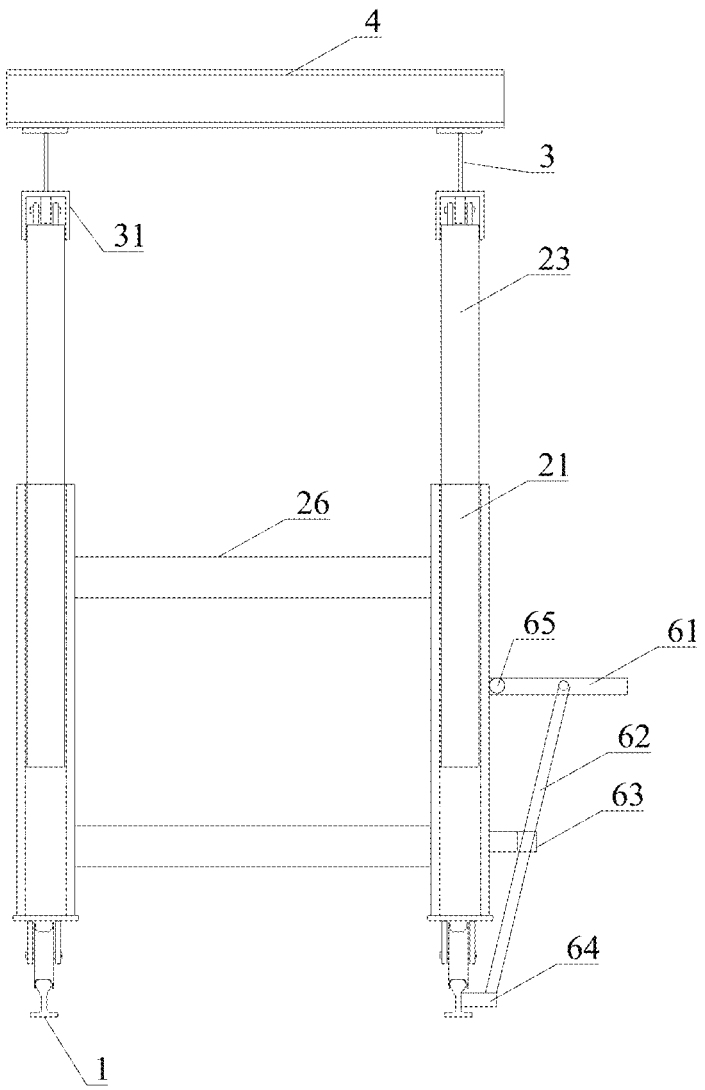
FIG. 5 is a schematic diagram of the support frame for construction along the rail track of the existing line when the brake device is applied.
Figure 6:
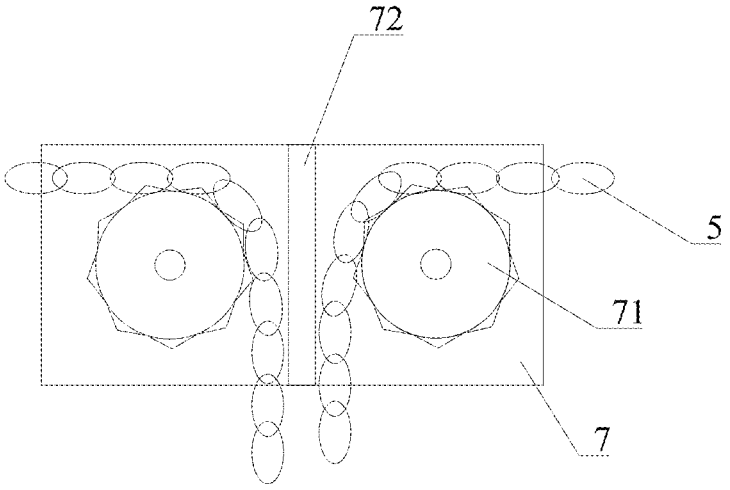
FIG. 6 is a schematic diagram of assembling the traction mechanism and the hinge.

Referring to FIGS. 1-6, a prefabricated movable and adjustable support frame for construction crossing over an existing line is provided, including a rail track 1 of the existing line, an adjustable support 2, a slideway stringer 3, a support beam 4, a hinge 5, a brake device 6, and a traction mechanism 7, where the number of the adjustable supports 2 is two, each of the adjustable supports 2 include 4 pillar assemblies, each of the pillar assemblies includes an outer column 21 and an inner column 23, the inner column 23 is inserted into the outer column 21 and can slide vertically inside the outer column 21, a lower end of the outer column 21 is connected to a lower rail wheel 22 that can roll on the rail track 1 of the existing line, an upper end of the inner column 23 is connected to an upper pulley 24, the inner columns 23 adjacent to each other and the outer columns 21 adjacent to each other along the rail track of the existing line are connected by hinged nodes through a cross brace assembly 25, with a distance there between adjustable, and the inner columns 23 adjacent to each other and the outer columns 21 adjacent to each other along a direction perpendicular to the rail track of the existing line are connected by a fixed crossbar 26, with an axis distance there between equal to the track gauge of the existing line; the slideway stringer 3 is arranged on the adjustable support 2, a chute type slideway 31 is provided at a lower end of the slideway stringer 3, and the inner column 23 and the upper pulley 24 disposed at the upper end thereof can be inserted into and roll along the chute type slideway 31; the support beam 4 is arranged across the slideway stringer 3 and serves as a supporting end of the support frame for construction; the number of the hinges 5 is two, respectively installed between the outer columns 21 of the two adjustable support 2 adjacent to each other along the rail track of the existing line and connected to the traction mechanism 7; and the number of the brake devices 6 is two, respectively installed on a side of the outer columns 21 of the two adjustable supports 2.

In the embodiment, the outer column 21 is a circular steel pipe. Certainly, a square steel pipe may also be used.

In the embodiment, the outer diameter of the inner column 23 is 1-2 cm smaller than the inner diameter of the outer column 21.

In the embodiment, one side of the cross brace assembly 25 has an upper end hinged to the inner column 23 and a lower end hinged to the outer column 21, while the other side thereof has an upper end hinged to the inner column 23 adjacent thereto and a lower end hinged to the outer column 21 adjacent thereto.

In the embodiment, both ends of the fixed crossbar 26 are respectively connected to the outer column 21.

In the embodiment, an upper end of the slideway stringer 3 has an I-shaped cross-section. Certainly, it may also be designed as a tubular cross-section.

In the embodiment, the inner diameter of the chute type slideway 31 is 1-2 cm larger than the outer diameter of the inner column 23.

In the embodiment, limiting baffles 32 are welded at a certain spacing inside the chute type slideway 31.

In the embodiment, the hinge 5 may be a ring buckle hinge. Certainly, a ratchet buckle hinge may also be used.

In the embodiment, the traction mechanism 7 includes a traction motor connected to two output shafts through a gearbox provided with forward and reverse gears, each of the output shafts is provided with a gear 71, a separating baffle 72 is provided in the middle of the gears 71, the gears 71 are assembled and connected to both ends of the hinge 5, and the traction motor drives the gears 71 to rotate toward or away from each other to achieve tensioning or relaxing of the hinge 5.

In the embodiment, the brake device 6 includes a handle 61, a slidable connecting rod 62, a slidable snap ring 63, and a brake end 64, where an end of the slidable snap ring 63 is provided with a sliding groove, the inner diameter of the sliding groove is 1-2 cm larger than that of the sliding connecting rod 62, the slidable connecting rod 62 passes through the sliding groove of the slidable snap ring 63, having an upper end hinged to the handle 61 and a lower end connected to the brake end 64, the handle 61 is hinged to the outer column 21 through a handle joint 65, the distance between the hinged connection at the upper end of the slidable connecting rod 62 and the handle joint 65 is 2-3 times the length of the slidable snap ring 63, when the handle 61 is leveled, the brake end 64 can abut against the rail track 1 of the existing line, and when the handle 61 is turned upward, the slidable connecting rod 62 drives the brake end 64 to break away from the rail track 1 of the existing line.

After the support frame for construction is assembled and moved to a construction site, the handle of the brake device 6 is pulled up to fix the support frame for construction in place, and the hinge 5 is tensioned/relaxed through the traction mechanism 7 so that the angle of the cross brace assembly 25 changes to drive the inner column 23 to rise/fall, thereby driving the slideway stringer 3 and the support beam 4 to rise/fall.

A method of installing the prefabricated movable and adjustable support frame for construction crossing over an existing line is further proposed, including the following steps:

(1) placing two of the outer columns 21 at a spacing equal to the track gauge of the existing line, and fixing them by welding or bolting with the fixed crossbar 26, arranging 2 sets respectively, and installing the brake device 6 on the outside of each of the outer columns 21;

(2) inserting the inner column 23 into the outer column 21 to form a pillar assembly, and then connecting the cross brace assembly 25 along the rail track of the existing line;

(3) lifting the assembled adjustable support 2 onto the rail track 1 of the existing line, and placing the hinge 5 between the outer columns 21 adjacent to each other along the rail track of the existing line, with both ends thereof inserted into the traction mechanism 7;

(4) lifting the slideway stringer 3 onto the adjustable support 2, with an upper rail wheel 22 of the inner column 23 in the adjustable support 2 inserted into the chute type slideway 31 of the slideway stringer 3, and placing one of the adjustable supports 2 in a partition on one side of the limiting baffle 32 in the slideway stringer 3;

(5) placing the support beam 4 across the slideway stringer 3 as the supporting end of the support frame for construction;

(6) during construction crossing over the existing line, pulling up the handle 61 of the brake device 6 to drive the brake end 64 to break away from the rail track 1 of the existing line, rolling the entire support frame on the rail track 1 of the existing line to a designated position, and then leveling the handle 61 of the brake device 6;

(7) starting the traction mechanism 7 to control the hinge 5 to be contracted, thereby tensioning the hinge 5 to reduce the length thereof so that the angle of the cross brace assembly 25 changes to push the inner column 23 to rise, thus lifting the slideway stringer 3 and the support beam 4 to a designated height, and then stopping the traction mechanism 7; and (8) when the construction of a current section is completed and it needs to move to a next section, starting the traction mechanism 7 to control the hinge 5 to be released, thereby relaxing the hinge 5 to increase both the spacing between the inner columns 23 adjacent to each other and the spacing between the outer columns 21 adjacent to each other so that the angle of the cross brace assembly 25 changes to cause the inner columns 23, the slideway stringer 3, and the support beam 4 to fall naturally; and pulling up the handle of the brake device 6 to transfer the entire support frame along the rail track 1 of the existing line to the next section.

Beneficial effects of the present invention: the connecting assemblies in the support frame are connected by insertion or hinging, thereby allowing for fully prefabricated assembly/disassembly. After the construction is completed, the assemblies can be quickly disassembled, and since individual members are small in size, they are convenient for storage and transportation after disassembly. The support frame can be combined through a series of standardized inner columns 23, outer columns 21, and cross brace assemblies 25 to form support frames meeting different length requirements, and through a combination of the lower rail wheel 22 and the upper pulley 24 at the end of the adjustable support 2, the entire support frame can be slid and transferred using the rail track 1 of the existing line, thereby facilitating position adjustment and transfer of the support frame between different construction sites; in addition, the height of the support frame can be flexibly adjusted and controlled through the hinge 5 and the traction mechanism 7 in accordance with the construction requirements.

Although exemplary embodiments of the present invention have been described above in conjunction with the accompanying drawings, the present invention is not limited to the implementation manners described above, and these implementation manners are only illustrative rather than restrictive. Inspired by the present invention, those of ordinary skill in the art can also make many other forms without departing from the spirit of the present invention and the scope protected by the claims, which shall all fall within the protection scope of the present invention.

What is claimed is:

1. A prefabricated movable and adjustable support frame for construction crossing over an existing line, comprising a rail track of the existing line, an adjustable support, a slideway stringer, a support beam, a hinge, a brake device, and a traction mechanism, wherein the adjustable support comprises 4 pillar assemblies, each of the pillar assemblies comprises an outer column and an inner column, the inner column is inserted into the outer column and can slide vertically inside the outer column, a lower end of the outer column is connected to a lower rail wheel that can roll on the rail track of the existing line, an upper end of the inner column is connected to an upper pulley, the inner columns adjacent to each other and the outer columns adjacent to each other along the rail track of the existing line are connected by hinged nodes through a cross brace assembly, with a distance there between adjustable, and the inner columns adjacent to each other and the outer columns adjacent to each other along a direction perpendicular to the rail track of the existing line are connected by a fixed crossbar, with an axis distance there between equal to the track gauge of the existing line; the slideway stringer is arranged on the adjustable support, a chute type slideway is provided at a lower end of the slideway stringer, and the inner column and the upper pulley disposed at the upper end thereof can be inserted into and roll along the chute type slideway; the support beam is arranged across the slideway stringer and serves as a supporting end of the support frame for construction; the hinge is installed between the outer columns of the adjustable support adjacent to each other along the rail track of the existing line and connected to the traction mechanism; and the brake device is installed on a side of the outer column of the adjustable support and comprises a handle, a slidable connecting rod, a slidable snap ring, and a brake end, wherein an end of the slidable snap ring is provided with a sliding groove, the slidable connecting rod passes through the sliding groove, having an upper end hinged to the handle and a lower end connected to the brake end, the handle is hinged to the outer column through a handle joint, when the handle is leveled, the brake end can abut against the rail track of the existing line, and when the handle is turned upward, the slidable connecting rod drives the brake end to break away from the rail track of the existing line.

2. The prefabricated movable and adjustable support frame for construction crossing over an existing line of claim 1, wherein the outer diameter of the inner column is 1-2 cm smaller than the inner diameter of the outer column.

3. The prefabricated movable and adjustable support frame for construction crossing over an existing line of claim 1, wherein one side of the cross brace assembly has an upper end hinged to the inner column and a lower end hinged to the outer column, while the other side thereof has an upper end hinged to the inner column adjacent thereto and a lower end hinged to the outer column adjacent thereto.

4. The prefabricated movable and adjustable support frame for construction crossing over an existing line of claim 1, wherein both ends of the fixed crossbar are respectively connected to the outer column.

5. The prefabricated movable and adjustable support frame for construction crossing over an existing line of claim 1, wherein the inner diameter of the chute type slideway is 1-2 cm larger than the outer diameter of the inner column.

6. The prefabricated movable and adjustable support frame for construction crossing over an existing line of claim 1, wherein limiting baffles are welded at a certain spacing inside the chute type slideway.

7. The prefabricated movable and adjustable support frame for construction crossing over an existing line of claim 1, wherein the hinge is a ring buckle hinge or a ratchet buckle hinge.

8. The prefabricated movable and adjustable support frame for construction crossing over an existing line of claim 1, wherein the traction mechanism comprises a traction motor connected to two output shafts through a gearbox provided with forward and reverse gears, each of the output shafts is provided with a gear, a separating baffle is provided in the middle of the gears, the gears are assembled and connected to both ends of the hinge, and the traction motor drives the gears to rotate toward or away from each other to achieve tensioning or relaxing of the hinge.

9. A method of installing the prefabricated movable and adjustable support frame for construction crossing over an existing line, comprising the following steps:

(1) placing two of the outer columns at a spacing equal to the track gauge of the existing line, and fixing them by welding or bolting with the fixed crossbar, arranging 2 sets respectively, and installing the brake device on the outside of each of the outer columns;

(2) inserting the inner column into the outer column to form a pillar assembly, and then connecting the cross brace assembly along the rail track of the existing line to form an adjustable support;

(3) lifting the assembled adjustable support onto the rail track of the existing line, and placing the hinge between the outer columns adjacent to each other along the rail track of the existing line, with both ends thereof inserted into the traction mechanism;

(4) lifting the slideway stringer onto the adjustable support, with an upper pulley of the inner column in the adjustable support inserted into the chute type slideway of the slideway stringer, and placing one of the adjustable supports in a partition on one side of the limiting baffle in the slideway stringer;

(5) placing the support beam across the slideway stringer as the supporting end of the support frame for construction;

(6) during construction crossing over the existing line, pulling up the handle of the brake device to drive the brake end to break away from the rail track of the existing line, rolling the entire construction support frame on the rail track of the existing line to a designated position, and then leveling the handle of the brake device;

(7) starting the traction mechanism to control the hinge to be contracted, thereby tensioning the hinge to reduce the length thereof so that the angle of the cross brace assembly changes to push the inner column to rise, thus lifting the slideway stringer and the support beam to a designated height, and then stopping the traction mechanism; and (8) when the construction of a current section is completed and it needs to move to a next section, starting the traction mechanism to control the hinge to be released, thereby relaxing the hinge to increase both the spacing between the inner columns adjacent to each other and the spacing between the outer columns adjacent to each other so that the angle of the cross brace assembly changes to cause the inner columns, the slideway stringer, and the support beam to fall naturally; and pulling up the handle of the brake device to transfer the entire construction support frame along the rail track of the existing line to the next section.

* * * * *